US006612858B1

(12) United States Patent
Stockhaus

(10) Patent No.: US 6,612,858 B1
(45) Date of Patent: Sep. 2, 2003

(54) DEVICE FOR UNLOCKING AN ELECTRONIC COMPONENT THAT IS INSERTIBLE INTO A RECEIVING DEVICE

(75) Inventor: Andreas Stockhaus, Berlin (DE)

(73) Assignee: Infineon Technologies AG, Munich (DE)

( * ) Notice: Subject to any disclaimer, the term of this patent is extended or adjusted under 35 U.S.C. 154(b) by 203 days.

(21) Appl. No.: 09/705,607

(22) Filed: Nov. 3, 2000

(51) Int. Cl.[7] ..... H01R 13/627

(52) U.S. Cl. ..... 439/352; 439/353; 439/354; 361/728

(58) Field of Search ..... 439/352, 353, 439/354, 357; 361/725–728, 732, 754, 759, 740

(56) References Cited

U.S. PATENT DOCUMENTS 5,772,461 A * 6/1998 Yu ..... 439/352
6,095,843 A 8/2000 Kaneko et al.

FOREIGN PATENT DOCUMENTS

DE 33 32 658 C2 3/1985
DE 42 44 680 A1 11/1993
DE 198 47 843 A1 5/2000
EP 1 001 498 A2 5/2000
EP 1 048 965 A2 11/2000

* cited by examiner

*Primary Examiner*—Khiem Nguyen
(74) *Attorney, Agent, or Firm*—Laurence A. Greenberg; Werner H. Stemer; Gregory L. Mayback

(57) ABSTRACT

An apparatus for unlocking an electronic component to be inserted into a retaining device, in particular a transceiver, and held in the retaining device by a locking element, such as a tongue. The apparatus has an unlocking device is integrally formed with the component housing or with a part thereof. The unlocking device is a rocker formed as part of the component and has an unlocking part for moving the unlocking device into an operated position and for unlocking the locking element in that position. An integral reset spring, which can be a leaf or torsion spring, connects the rocker. The operating direction is at right angles to a removal or ejection direction of the component from the retaining device. Preferably, the unlocking device and the component are plastic. The unlocking apparatus allows easily controllable removal of a component, is of simple construction, and can be produced cost-effectively.

50 Claims, 11 Drawing Sheets

DEVICE FOR UNLOCKING AN ELECTRONIC COMPONENT THAT IS INSERTIBLE INTO A RECEIVING DEVICE

BACKGROUND OF THE INVENTION

FIELD OF THE INVENTION

The invention relates to an apparatus for unlocking an electronic component, which can be inserted into a retaining apparatus, in particular a transceiver, which is held in the retaining apparatus by means of a locking element, with the apparatus having unlocking means for unlocking the locking element, where the unlocking means are formed integrally with the housing or with a part of the housing of the component. It is particularly suitable for unlocking transceivers which are inserted in a sheet-metal structure arranged on a printed circuit board and are latched to said structure (pluggable transceiver).

It is known for electronic transceivers to be inserted into a sheet-metal structure which is arranged on a printed circuit board. Such arrangements are used, in particular in so-called small form factor (SFF) pluggable transceivers which are physically small. An unlocking apparatus is provided for removing the transceiver from the sheet-metal structure, operates a latching element, and thus allows the transceiver to be removed.

A corresponding arrangement is shown in FIG. 5. To couple a transceiver 1 to the connections of a printed circuit board 3, the transceiver is pushed into a housing 2 which is connected to the printed circuit board 3. The housing 2 forms a sheet-metal cage which is normally composed of copper alloy or steel alloy and is formed from a lower part 21, connected to the printed circuit board, and an upper part 22 which can be placed on the lower part. A plug part 6 arranged in the housing is used to make contact with corresponding contacts on the transceiver 1. The transceiver 1 has electronic transducers in a manner known per se, such as a Fabry-Perot Laser or VCSEL laser, and a photodiode.

A sheet-metal tongue 5 is provided on the lower part 21 of the housing 2 in order to secure the transceiver 1 in the housing 2 and, once the transceiver 1 has been pushed into the housing 2, latches behind a latching tab arranged on the bottom face of the transceiver 1 and thus locks the transceiver 1 in the housing 2. In order to remove the transceiver 1 from the housing 2 once again, a separate unlocking element 4 is provided according to the prior art, which pushes the sheet-metal tongue 5 downwards when it is operated, and thus unlocks the transceiver 1.

This relationship is shown in more detail in FIGS. 6*a*, 6*b*. The section view in FIG. 6*a* and the bottom view shown in FIG. 6*b* show a latching tab 7 on the housing of the transceiver 1, behind which the sheet-metal tongue (see FIG. 6) comes to rest when the transceiver 1 is latched in. The separate unlocking element 4, which is formed by a slide 4, is provided for unlocking. The slide 4 can be moved in the direction of the latching tab 7 and, when moved appropriately, has inclined unlocking tabs 41 which engage under the sheet-metal tongue 5 so that the latter is pressed away downward and breaks contact with the latching tab 7. The transceiver 1 is now unlocked and can be removed from the connection housing 2.

A first disadvantage of the known arrangement is that the moving slide must be attached to the transceiver housing separately. Secondly, the unlocking element is operated in the direction opposite the movement direction when the transceiver is being removed, that is to say the operating direction is in the wrong sense since a part which is attached to the housing must be pushed in a direction opposite to the removal direction. A further disadvantage of the known arrangement is that the unlocking element must be moved through several millimeters along the bottom face of the transceiver, and is thus difficult to reach and operate.

SUMMARY OF THE INVENTION

The present invention is based on the object of providing an apparatus for unlocking an electronic component which can be inserted a retaining apparatus, in particular a transceiver, which apparatus allows easily controllable removal of the component, is of simple construction and can be produced cost-effectively.

This object is achieved according to the invention by an unlocking apparatus for unlocking an electronic component which can be inserted into a retaining apparatus, in particular a transceiver, which is held in the retaining apparatus by means of a locking element, with the apparatus having unlocking means for unlocking the locking element, the unlocking means being formed integrally with the housing or with a part of the housing of the component. Preferred and advantageous refinements of the invention are specified in the dependent claims.

Accordingly, the invention provides that, in order to unlock a locking element of the retaining apparatus, the unlocking means are formed integrally with the housing of the component or with a part of the housing of the component. Since the unlocking means and the housing are integral, this results in an integral solution which integrates the unlocking means in the housing and thus saves an additional part in comparison to the prior art. The production cost is thus reduced and assembly is also simplified, since the unlocking means no longer need be fitted to the housing. This thus provides a simple and cost-effective solution.

In one preferred embodiment of the invention, the unlocking means have a rocker which is formed on the housing or housing part. The rocker in this case comprises an operating part, which can be operated by an operator for unlocking, and an unlocking part. When the operating part has not been operated, the rocker is located in an unoperated position. When the operating part is operated, the rocker moves to an operated position, in which the locking element is unlocked. The use of a rocker to initiate unlocking of the component provides a simple and cost-effective solution. The operating part is in this case preferably lengthened or bent in such a way that it is easily accessible to, and can correspondingly be operated easily by, an operator.

In one preferred development, the rocker is connected to at least one reset spring. The reset spring, for example a leaf spring or a torsion spring, is in this case preferably likewise formed integrally with the housing, or with a part of the housing of the component. The use of a reset spring ensures that the component is unlocked only when the operating part of the rocker is operated and that the component is otherwise securely latched in the retaining apparatus. The reset spring which is used engages on the rocker, preferably in the region of the rotation axis or tilting axis of said rocker, in order to ensure that the rocker is reset to the unoperated state in a simple manner. The reset spring preferably results in the rocker being connected to the housing or housing part of the component in this case.

In one preferred refinement of the invention, the operating part of the rocker is arranged in the region of the optical inlet in the transceiver. In this way, the operating part is easily accessible and simple to operate. In order to avoid reducing the size of the retaining opening in the optical inlet by the arrangement of the operating part, the optical inlet in this case preferably has an elongated depression, which at least partially accommodates the operating part and, if appropriate, the unlocking part as well. Since the unlocking part in such an arrangement is arranged in the interior of the housing, the housing wall has an opening through which the unlocking part makes contact with the locking element in the operated state, so that the unlocking process can be carried out.

In one further advantageous refinement of the invention, the operating part and the unlocking part are formed in the bottom face of the housing of the component. In consequence, the unlocking part is immediately adjacent to the locking element, which can be operated when required.

The operating direction of the operating part is preferably at right angles to the removal direction of the component, or even in the removal direction of the component. Such an operating direction can be provided by suitable arrangement of the rocker, which is preferably in the form of the unlocking apparatus. An operating direction at right angles to or even in the removal direction of the component avoids the situation in the prior art where a movement in the opposite direction to the removal direction must first of all be carried out for unlocking.

The unlocking apparatus according to the invention and the housing are preferably manufactured integrally from plastic, for example using the cost-effective injection-molding method.

The invention will be explained in more detail in the following text using a number of exemplary embodiments and with reference to the figures of the drawing.

DESCRIPTION OF THE PREFERRED EMBODIMENTS

Figure 5:
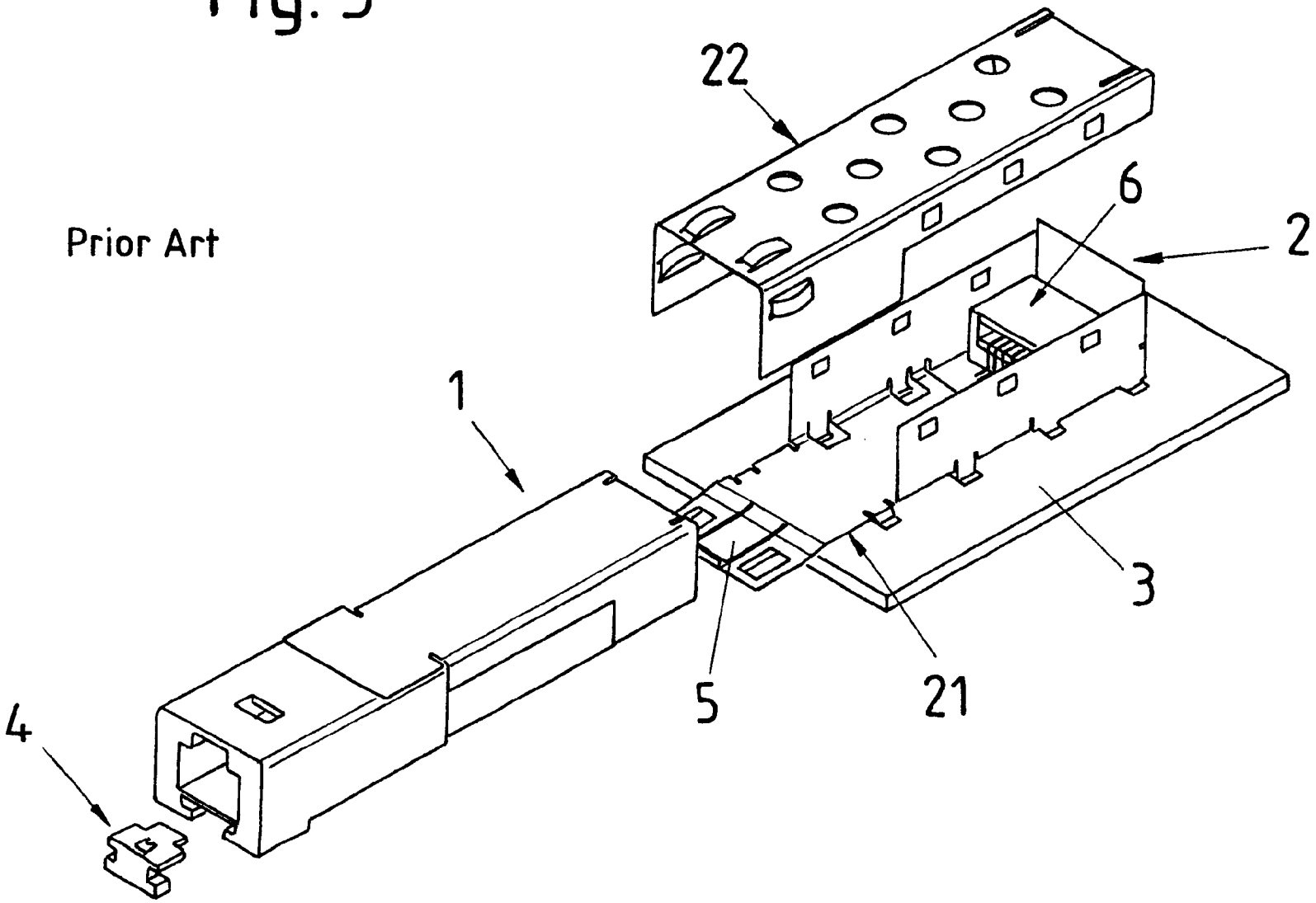
Fig. 5 Prior Art
FIG. 5 shows a transceiver and an unlocking apparatus according to the prior art.
Figure 6A:
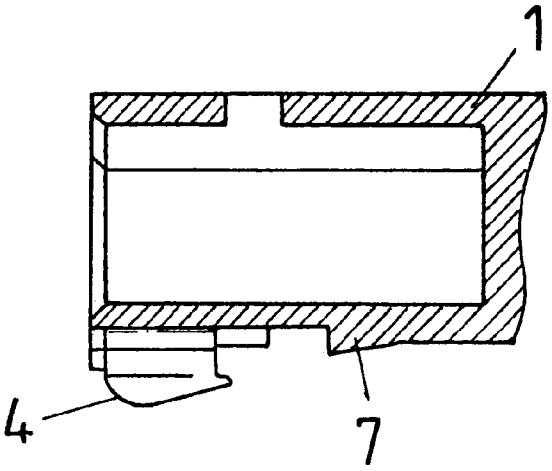
Fig. 6a Prior Art
FIG. 6*a* shows a sectional illustration of the transceiver and of the unlocking apparatus shown in FIG. 5.
Figure 6B:
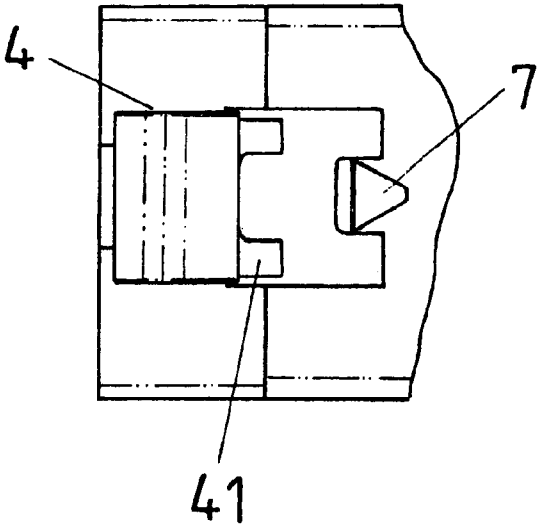
Fig. 6b Prior Art
FIG. 6*b* shows a bottom view of the transceiver and of the unlocking apparatus shown in FIG. 5.

A transceiver with the unlocking apparatus according to the prior art was explained in the introduction, with reference to FIGS. 5, 6*a* and 6*b*.

Figure 1:
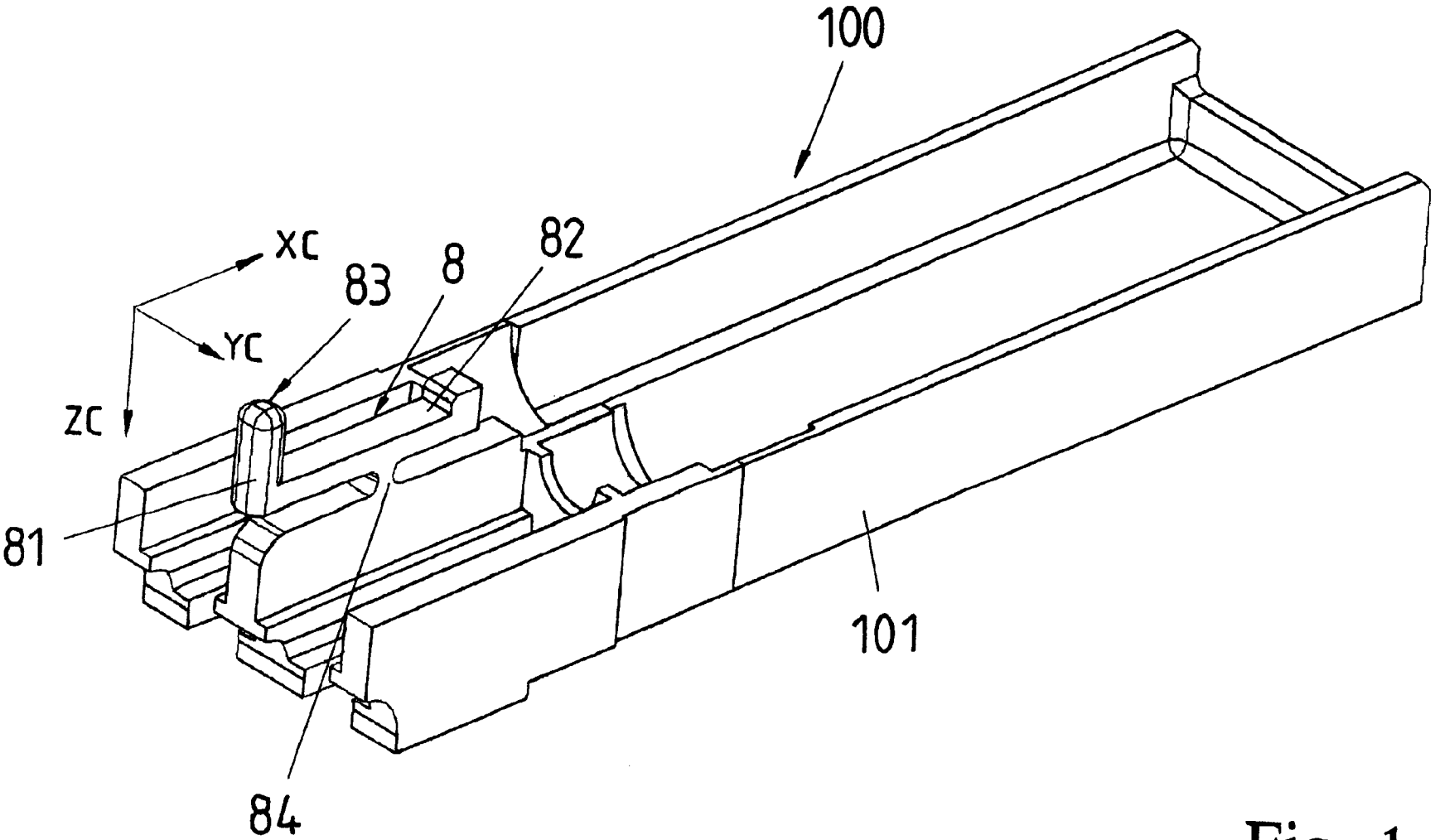
FIG. 1 shows a housing lower part of a transceiver with an unlocking apparatus according to the invention.

FIG. 1 shows an unlocking apparatus 8 according to the invention, which is formed integrally with a housing lower part 101 of a transceiver 100. The unlocking apparatus 8 and the housing lower part 101 are in this case preferably composed of a plastic and are formed jointly.

The unlocking apparatus 8 is in the form of a rocker which has a front operating part 81, facing an operator, and an unlocking part 82. At its end, the operating part 81 is bent 90°, thus forming an operating surface 83 which can easily be operated by an operator. On its head part, the unlocking part 82 of the rocker 8 forms a pushing surface, which presses against a locking element when the operating part 81 is being operated and in consequence results in unlocking, as will be described below.

The rocker 8 is connected to the housing lower part 101 via a web 84. The web 84 in this case forms the rotation or tilting axis of the rocker 8, that is to say, when the operating part 81 is being operated, the rocker 8 tilts about the axis that is governed by the web 84, so that the tongue 82 is moved upward when the projection 83 is pressed downward.

At the same time, the web 84 is in the form of a leaf spring and thus represents a reset spring which ensures that the rocker 8 is always in a defined initial position when in the unoperated state.

Figure 2A:
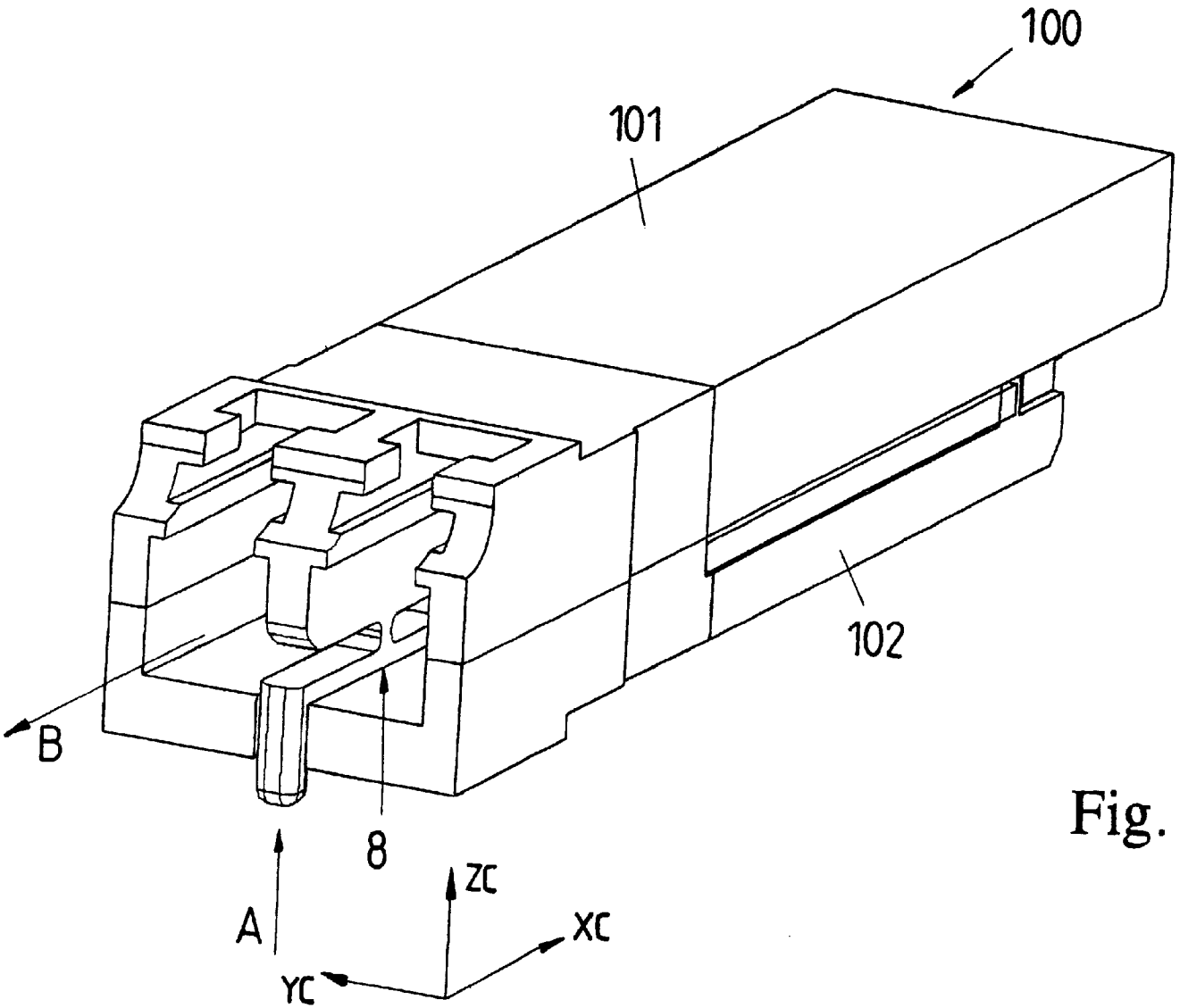
FIG. 2*a* shows a complete transceiver with the unlocking apparatus from FIG. 1, illustrated in a first form.

FIG. 2*a* shows the complete transceiver 100, in which a housing upper part 102 is placed on the housing lower part 101. The two housing parts are, for example, mechanically bonded to one another. In this case, it is irrelevant to the invention whether two or more housing parts are provided or even if the housing is integral. The only essential feature is that the unlocking apparatus is formed integrally with at least a part of the housing.

Figure 2B:
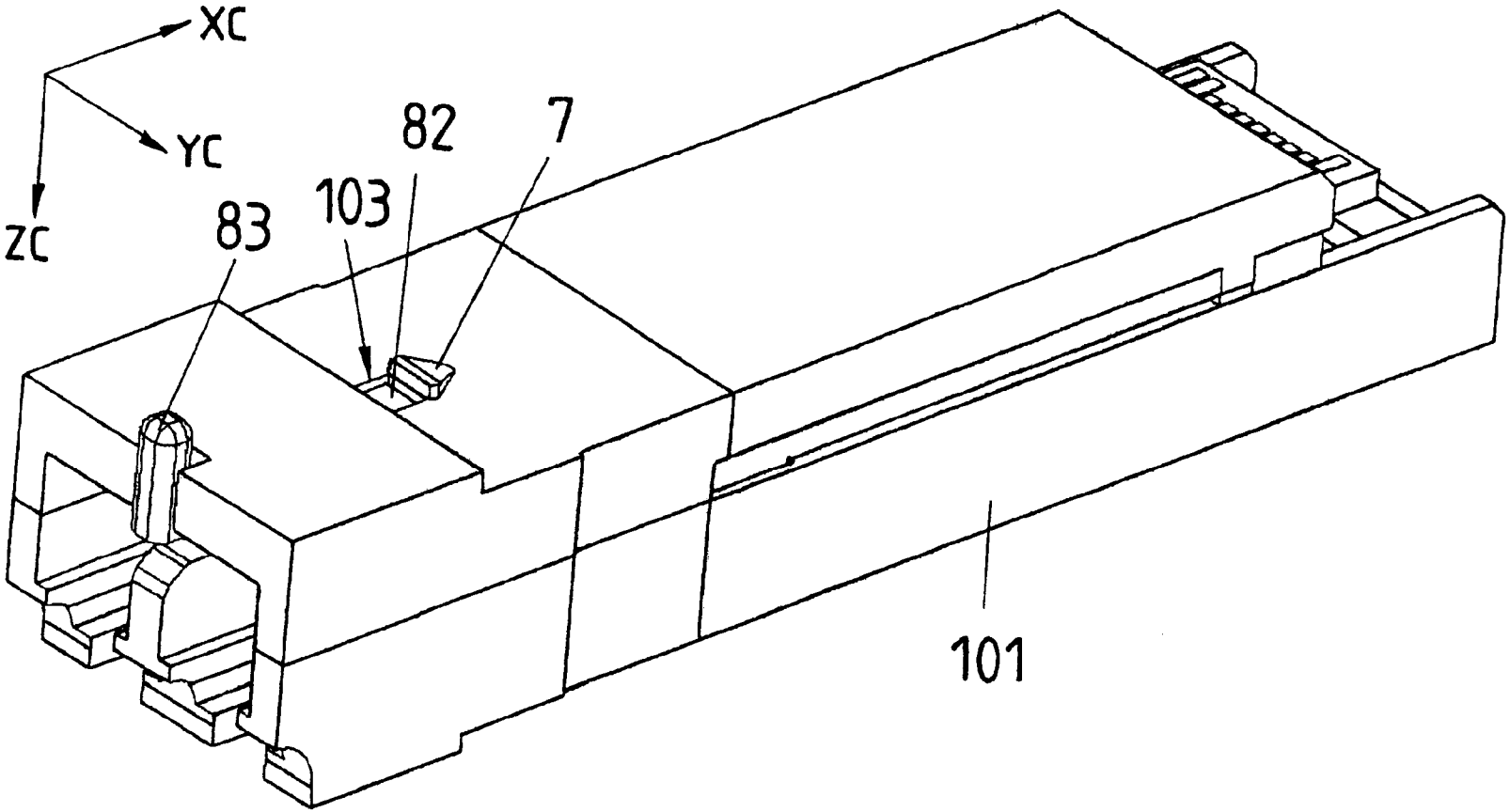
FIG. 2*b* shows a complete transceiver with the unlocking apparatus from FIG. 1, illustrated in a second form, rotated through 180° with respect to the view in FIG. 2*a;*

According to FIG. 2*b*, the housing upper part 102 has an opening 103 which accommodates the head part of the unlocking part 82 of the rocker 8. This ensures that, when the operating part 81 is being operated, the head part of the unlocking part 82 moves essentially at right angles to the surface of the housing 102, and out of the latter, so that a locking part, which rests on the head part, of a retaining apparatus for the transceiver 1, located behind a latching tab 7, can be unlocked.

In FIG. 2*a*, it can easily be seen that the operating direction A for unlocking the transceiver 100 runs at right angles to the ejection direction or removal direction B of the transceiver 100.

Figure 3:
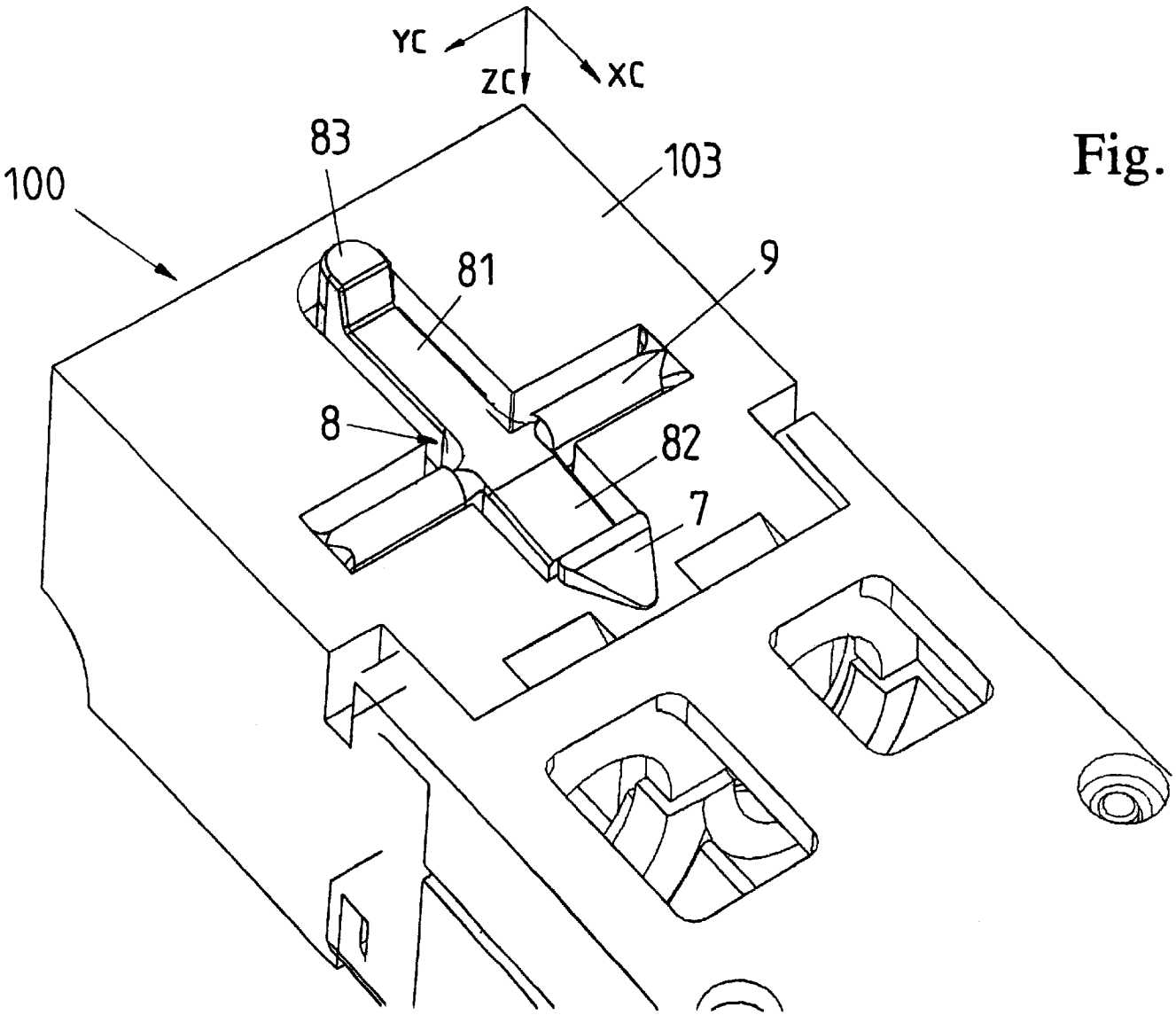
FIG. 3 shows a subregion of a transceiver housing with a second embodiment of the locking apparatus according to the invention.

FIG. 3 shows an alternative embodiment of an unlocking apparatus which is integrally connected to a transceiver housing. According to FIG. 3, the unlocking apparatus is once again in the form of a rocker 8, which comprises an operating part 81 with an operating surface 83, and an unlocking part 82 with a contact surface. The rocker 8 in this embodiment is cut directly into the housing surface of a housing part 103 of the transceiver 100. In this case, it is connected to the housing 103 in a sprung manner via a torsion spring 9. For this purpose, the torsion spring 9 is connected to the housing part 103 firstly in the region of the rotation axis of the rocker 8 and secondly at its lateral ends. The torsion spring 9 is in this case formed by a round plastic rod.

When the operating surface 83 is operated, the rocker 8 tilts about the axis governed by the torsion spring 9. In the process, firstly, the operating part 82 is moved upward. Secondly, the torsion spring 9 is twisted, so that the rocker 8 automatically returns to its initial position when the operating part 81 is released.

In FIG. 3, it is also easy to see a latching tab 7 on the housing part 103 behind which, in the locked state, a sheet-metal tongue (which is used as the locking element) of a retaining apparatus for the transceiver 100 comes to rest. When the operating part 81 is being operated, thus resulting in the unlocking part 82 being raised, such a sheet-metal tongue is moved away vertically upward from the housing surface and is thus disengaged from the latching tab 7, so that the transceiver 100 can be removed from the retaining apparatus.

Since the operating surface 83 of the operating part 81 projects from the surface of the housing part 103, the unlocking apparatus can be operated in a simple manner.

Figure 4A:
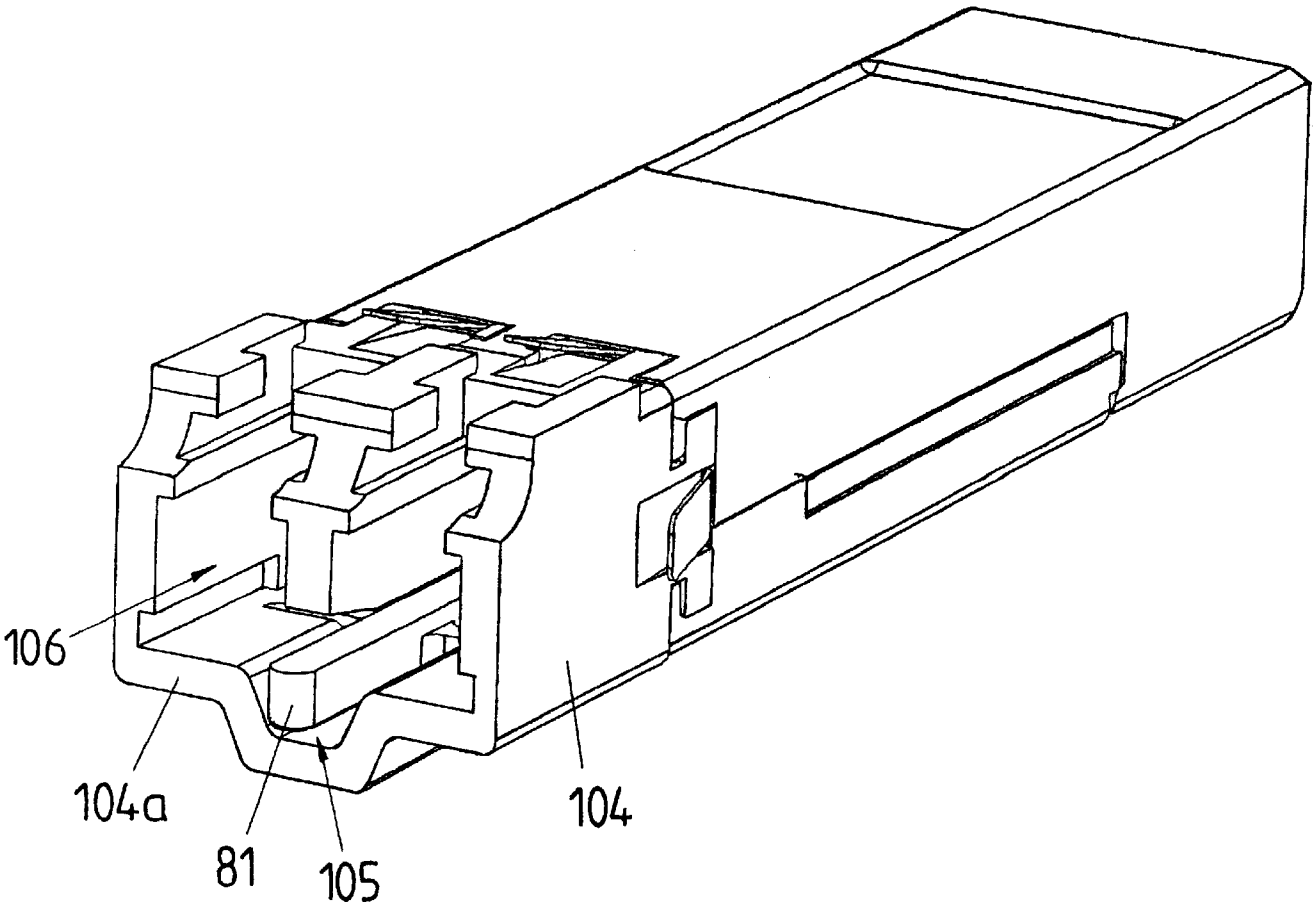
FIG. 4*a* shows a transceiver with an unlocking apparatus as shown in FIG. 1, with the unlocking apparatus being accommodated in a longitudinally running depression in the housing.

FIG. 4*a* shows a further exemplary embodiment of the invention, in which the unlocking apparatus is in principle in the form described with reference to FIG. 3. One difference is that the bottom face 104*a* of the housing part 104 has, in the center, a depression or groove 105 which runs in the longitudinal direction and which essentially contains the operating part 81 of the rocker. This ensures that the optical inlet 106 of the transceiver, which is used to accommodate the optical plugs, is not reduced in size by the operating element 81.

Figure 4B:
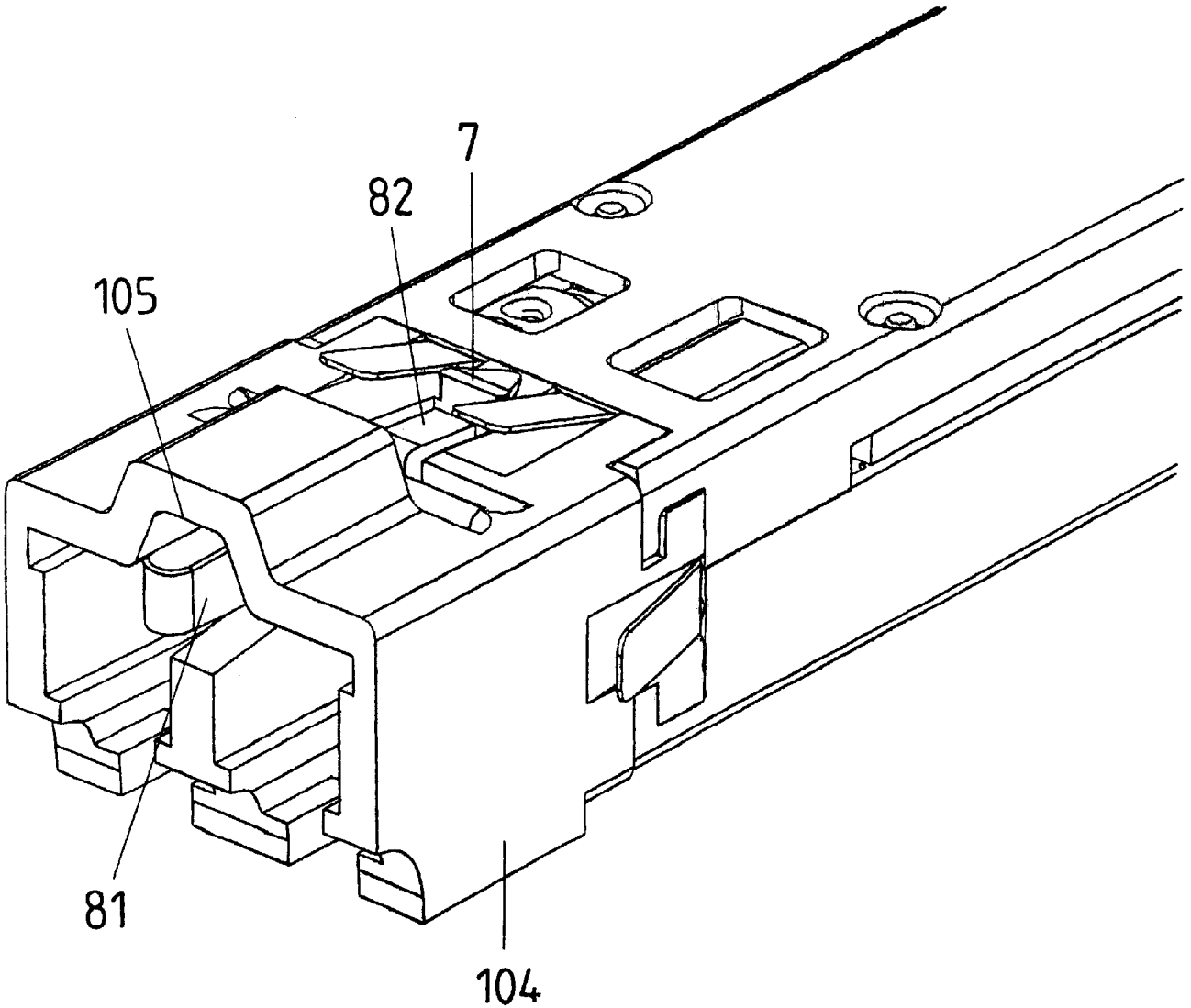
FIG. 4*b* shows the transceiver from FIG. 4*a* illustrated rotated through 180°.

FIG. 4*b* shows a view of the transceiver 100 rotated through 180°, in which the unlocking part 82 and the latching tab 7 can also be seen, in addition to the operating part 81 arranged in the groove 105.

Figure 4C:
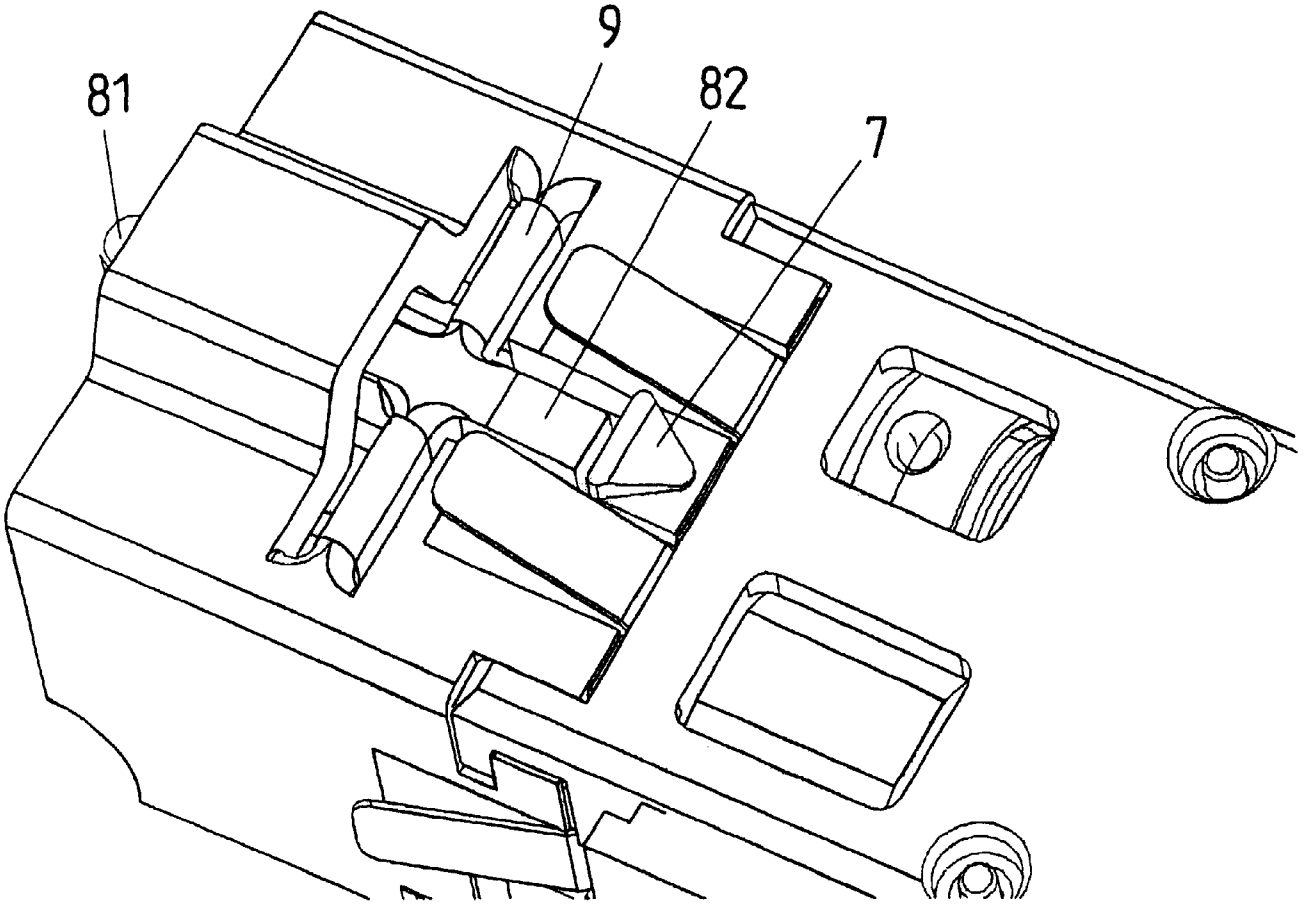
FIG. 4*c* shows a detailed view of the transceiver shown in FIGS. 4*a*, 4*b;*

According to FIG. 4*c*, a reset spring 9 is provided, which is formed in a corresponding manner to the reset spring in FIG. 5.

Figure 7:
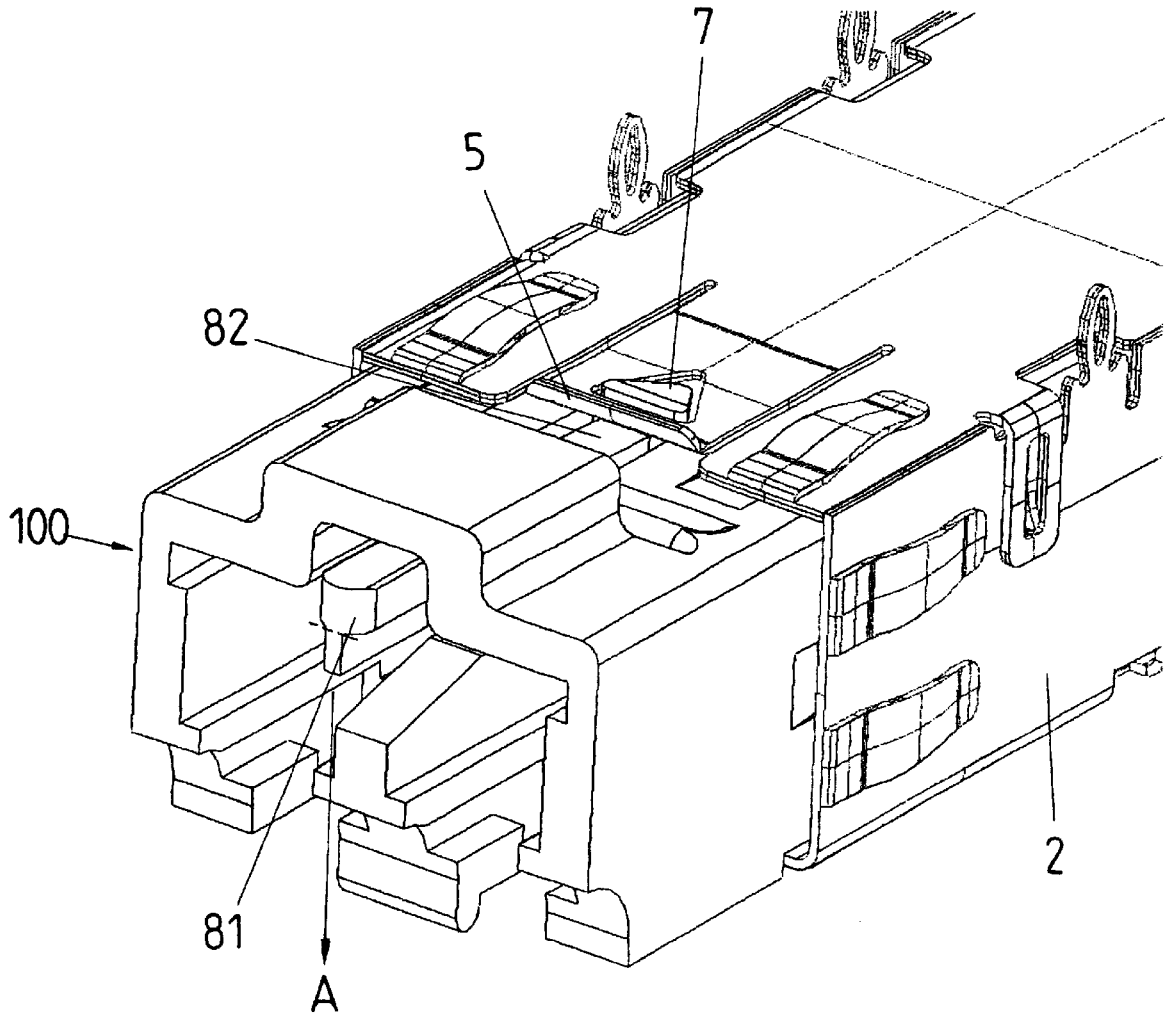
FIGS. 7 and 8 show the transceiver inserted into a housing.
Figure 8:
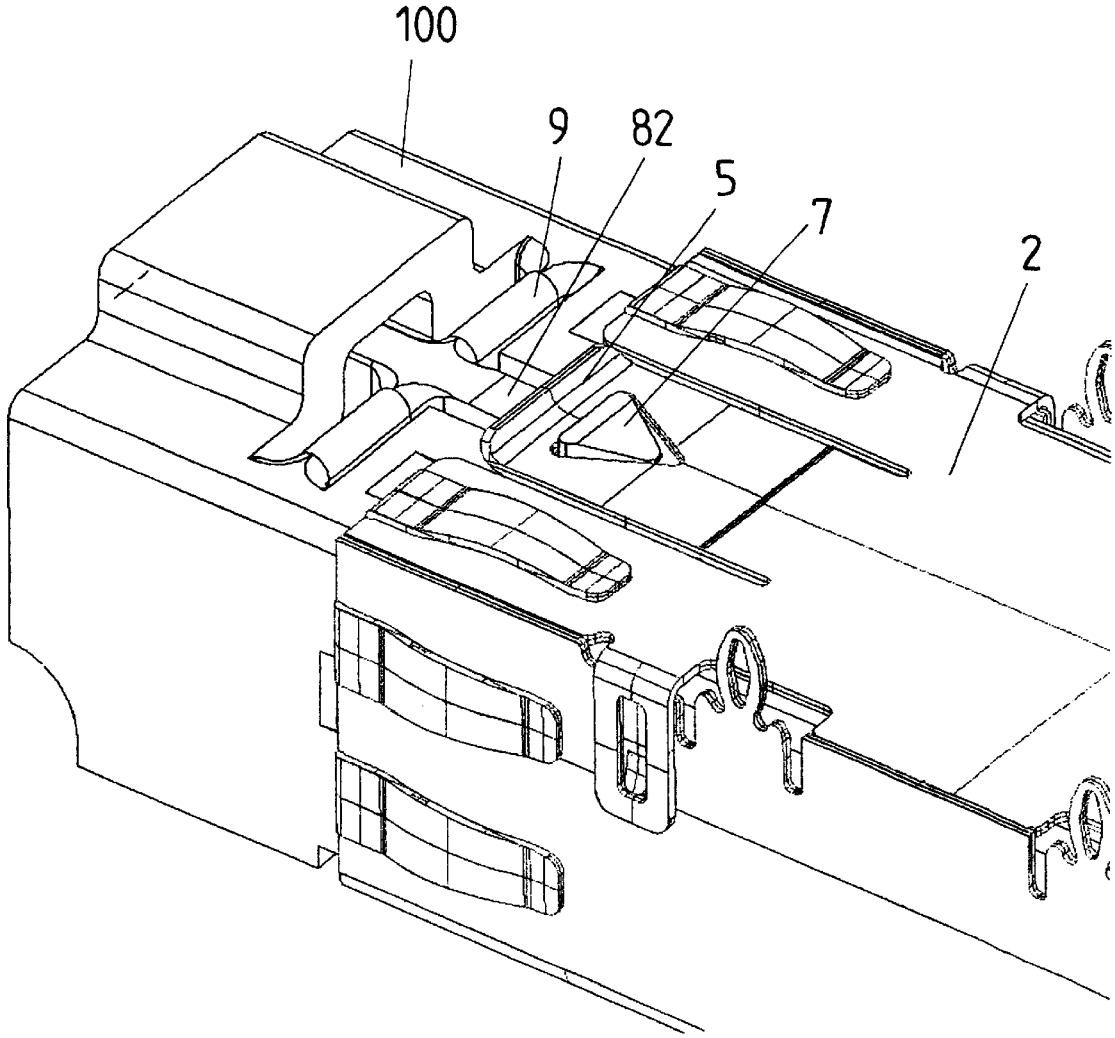

Once the transceiver 100 has been inserted completely into a housing 2, as shown in FIGS. 7 and 8, a sheet-metal spring 5 on the housing latches in behind the latching tab 7 of the transceiver 100, and thus locks the transceiver 100 to the housing 2. All that is required to release the lock is to press the easily accessible operating part 81 slightly vertically upward in the direction of the arrow A, as a result of which the unlocking part 82 presses the sheet-metal tongue away from the latching tab 7, overcoming the locking of the transceiver 100 to the housing 2.

The embodiment of the invention is not limited to the exemplary embodiments described above. The only essential feature for the invention is that the unlocking means of the unlocking apparatus are formed integrally with the housing or with a housing part of an electronic component.

What is claimed is:

1. An apparatus for unlocking an electronic component to be inserted into a retaining device and held in the retaining device by a locking element, the apparatus comprising:

a rocker integrally formed with the electronic component and movable between an initial position and an operated position for unlocking the locking element of the retaining device; and said rocker having an operating part moving said rocker to the operated position and an unlocking part including a head part, said head part extending outwardly from the electronic component in the operated position to unlock the locking element.

2. The apparatus according to claim 1, wherein:

the electronic component has at least one part; and said rocker is integrally formed with the at least one part.

3. The apparatus according to claim 1, including at least one reset spring connecting said rocker to the electronic component.

4. The apparatus according to claim 3, wherein said at least one reset spring is integrally formed with the electronic component.

5. The apparatus according to claim 3, wherein the electronic component has a part and said at least one reset spring is integrally formed with the part.

6. The apparatus according to claim 4, wherein:

said rocker has a rotation axis; and said at least one reset spring is a leaf spring connected to said rocker at a region of said rotation axis.

7. The apparatus according to claim 3, wherein:

said rocker has a rotation axis; and said at least one reset spring is a torsion spring connected to said rocker at a region of said rotation axis.

8. The apparatus according to claim 1, wherein said operating part has an operating direction at least one of right angles to and in the removal direction of the electronic component from the retaining device.

9. The apparatus according to claim 1, wherein:

the electronic component has a longitudinal axis; and said operating part has an operating direction perpendicular to the longitudinal axis.

10. The apparatus according to claim 1, wherein:

the electronic component is removed from the retaining device in a removal direction; and said operating part has an operating direction perpendicular to the removal direction.

11. The apparatus according to claim 1, wherein:

the electronic component leaves the retaining device in an ejection direction; and said operating part has an operating direction perpendicular to the ejection direction.

12. The apparatus according to claim 1, wherein:

the electronic component has a surface; and said operating part has an operating direction perpendicular to the surface of the electronic component.

13. The apparatus according to claim 1, wherein the electronic component is a transceiver.

14. The apparatus according to claim 13, wherein:

the transceiver has an optical inlet; and said operating part is disposed at the optical inlet.

15. The apparatus according to claim 14, wherein the optical inlet has an elongated depression accommodating said operating part.

16. The apparatus according to claim 14, wherein:

the electrical component has a housing wall defining an opening;

said unlocking part is disposed at the optical inlet; and said unlocking part contacts the locking element in said operated position through the opening.

17. The apparatus according to claim 14, wherein:

the electrical component has a housing with a bottom face, said operating part and said unlocking part are disposed on the bottom face.

18. The apparatus according to claim 14, wherein:

the retaining device has a sheet-metal tongue;

the electronic component is locked in the retaining device by a latched position of the sheet-metal tongue; and said rocker unlocks the sheet-metal tongue when said rocker is operated.

19. The apparatus according to claim 18, wherein said unlocking part removes the sheet-metal tongue from the latched position when said rocker is placed into said operated position.

20. The apparatus according to claim 14, wherein the retaining device is a metal structure to be fitted on a printed circuit board.

21. The apparatus according to claim 14, wherein the retaining device is a sheet-metal cage to be fitted on a printed circuit board.

22. The apparatus according to claim 14, wherein:

said rocker is integral to the electronic component; and the electronic component and said rocker are plastic.

23. The apparatus according to claim 14, wherein:

the electronic component has a part;

said rocker is integral to the part; and the electronic component, the part, and said rocker are plastic.

24. An apparatus for unlocking an electronic component to be inserted into a retaining device and held in the retaining device by a locking element, the apparatus comprising:

an unlocking device integrally formed with the electronic component and movable between an initial position and an operated position for unlocking the locking element of the retaining device; and said unlocking device having an operating part moving said operating device to the operated position and an unlocking part including a head part, said head part extending outwardly from the electronic component in the operated position to unlock the locking element.

25. The apparatus according to claim 24, wherein:

the electronic component has at least one part; and said unlocking device is integrally formed with the at least one part.

26. The apparatus according to claim 24, including at least one reset spring connecting said rocker to the electronic component.

27. The apparatus according to claim 26, wherein said at least one reset spring is integrally formed with the electronic component.

28. The apparatus according to claim 26, wherein the electronic component has a part and said at least one reset spring is integrally formed with the part.

29. The apparatus according to claim 26, wherein:

said unlocking device has a rotation axis; and said at least one reset spring is a leaf spring connected to said unlocking device at a region of said rotation axis.

30. The apparatus according to claim 26, wherein:

said unlocking device has a rotation axis; and said at least one reset spring is a torsion spring connected to said unlocking device at a region of said rotation axis.

31. The apparatus according to claim 24, wherein said operating part has an operating direction at least one of right angles to and in the removal direction of the electronic component from the retaining device.

32. The apparatus according to claim 24, wherein:

the electronic component has a longitudinal axis; and said operating part has an operating direction perpendicular to the longitudinal axis.

33. The apparatus according to claim 24, wherein:

the electronic component is removed from the retaining device in a removal direction; and said operating part has an operating direction perpendicular to the removal direction.

34. The apparatus according to claim 24, wherein:

the electronic component leaves the retaining device in an ejection direction; and said operating part has an operating direction perpendicular to the ejection direction.

35. The apparatus according to claim 24, wherein:

the electronic component has a surface; and said operating part has an operating direction perpendicular to the surface of the electronic component.

36. The apparatus according to claim 24, wherein the electronic component is a transceiver.

37. The apparatus according to claim 36, wherein:

the transceiver has an optical inlet; and said operating part is disposed at the optical inlet.

38. The apparatus according to claim 37, wherein the optical inlet has an elongated depression accommodating said operating part.

39. The apparatus according to claim 37, wherein:

the electrical component has a housing wall defining an opening;

said unlocking part is disposed at the optical inlet; and said unlocking part contacts the locking element in said operated position through the opening.

40. The apparatus according to claim 24, wherein:

the electrical component has a housing with a bottom face, said operating part and said unlocking part are disposed on the bottom face.

41. The apparatus according to claim 24, wherein:

the retaining device has a sheet-metal tongue;

the electronic component is locked in the retaining device by a latched position of the sheet-metal tongue; and said unlocking device unlocks the sheet-metal tongue when said unlocking device is operated.

42. The apparatus according to claim 41, wherein said unlocking part removes the sheet-metal tongue from the latched position when said unlocking device is placed into said operated position.

43. The apparatus according to claim 24, wherein the retaining device is a metal structure to be fitted on a printed circuit board.

44. The apparatus according to claim 24, wherein the retaining device is a sheet-metal cage to be fitted on a printed circuit board.

45. The apparatus according to claim 24, wherein:

the electronic component and said unlocking device are plastic.

46. The apparatus according to claim 24, wherein:

the electronic component has a part;

said unlocking device is integral to the part; and the electronic component, the part, and said unlocking device are plastic.

47. The apparatus according to claim 1, wherein:

said operating part and said unlocking part are disposed on opposite ends of said rocker.

48. The apparatus according to claim 47, wherein:

said rocker has a rotation axis disposed between said operating part and said unlocking part; and a control spring is connected to said rocker in the vicinity of said rotation axis.

49. The apparatus according to claim 24, wherein:

said operating part and said unlocking part are disposed on opposite ends of said unlocking device.

50. The apparatus according to claim 49, wherein:

said unlocking device has a rotation axis disposed between said operating part and said unlocking part; and a control spring is connected to said unlocking device in the vicinity of said rotation axis.

* * * * *